United States Patent [19]

Barcellos

[11] 4,060,479

[45] Nov. 29, 1977

[54] PROCESS FOR OBTAINING OIL, GAS, SULFUR AND OTHER PRODUCTS FROM OIL SHALE

[76] Inventor: Eduardo Da Costa Barcellos, Avenida Atlantica 290 Apt. 92, Rio de Janeiro, Brazil

[21] Appl. No.: 623,984

[22] Filed: Oct. 20, 1975

[30] Foreign Application Priority Data

Oct. 21, 1974 Brazil ..... 8744

[51] Int. Cl.[2] ..... C10G 1/02

[52] U.S. Cl. ..... 208/11 R; 201/8; 201/16; 201/34

[58] Field of Search ..... 208/11 R; 201/8, 16, 201/34

[56] References Cited

U.S. PATENT DOCUMENTS

| | | | |
|---|---|---|---|
| 1,704,956 | 3/1929 | Trumble | 201/16 |
| 2,434,815 | 1/1948 | Shaw | 201/16 |
| 2,639,263 | 4/1953 | Leffer | 201/16 |
| 2,725,347 | 11/1955 | Leffer | 208/11 R |
| 3,487,001 | 12/1969 | Needham | 208/11 R |
| 3,520,795 | 7/1970 | Schulman et al. | 208/11 R |
| 3,841,992 | 10/1974 | Jones et al. | 208/11 R |

*Primary Examiner*—Delbert E. Gantz
*Assistant Examiner*—James W. Hellwege
*Attorney, Agent, or Firm*—Emory L. Groff, Jr.

[57] ABSTRACT

A process for obtaining oil, gas, sulfur and other products from shale whereby there is effected drying, pyrolysis, gasification, combustion and cooling of pyrobituminous shale or similar rocks in a single passage of said shale continuously in a moving bed, the charge and discharge of the shale being intermittent and wherein the maximum temperature of the bed is maintained in the range of about 1050° C to 1200° C (1900° F to 2200° F) or higher. The shale is essentially completely freed from the organic matter, fixed carbon and sulfur, resulting in a clean solid residue which can be disposed of without harming the ecology.

15 Claims, 1 Drawing Figure

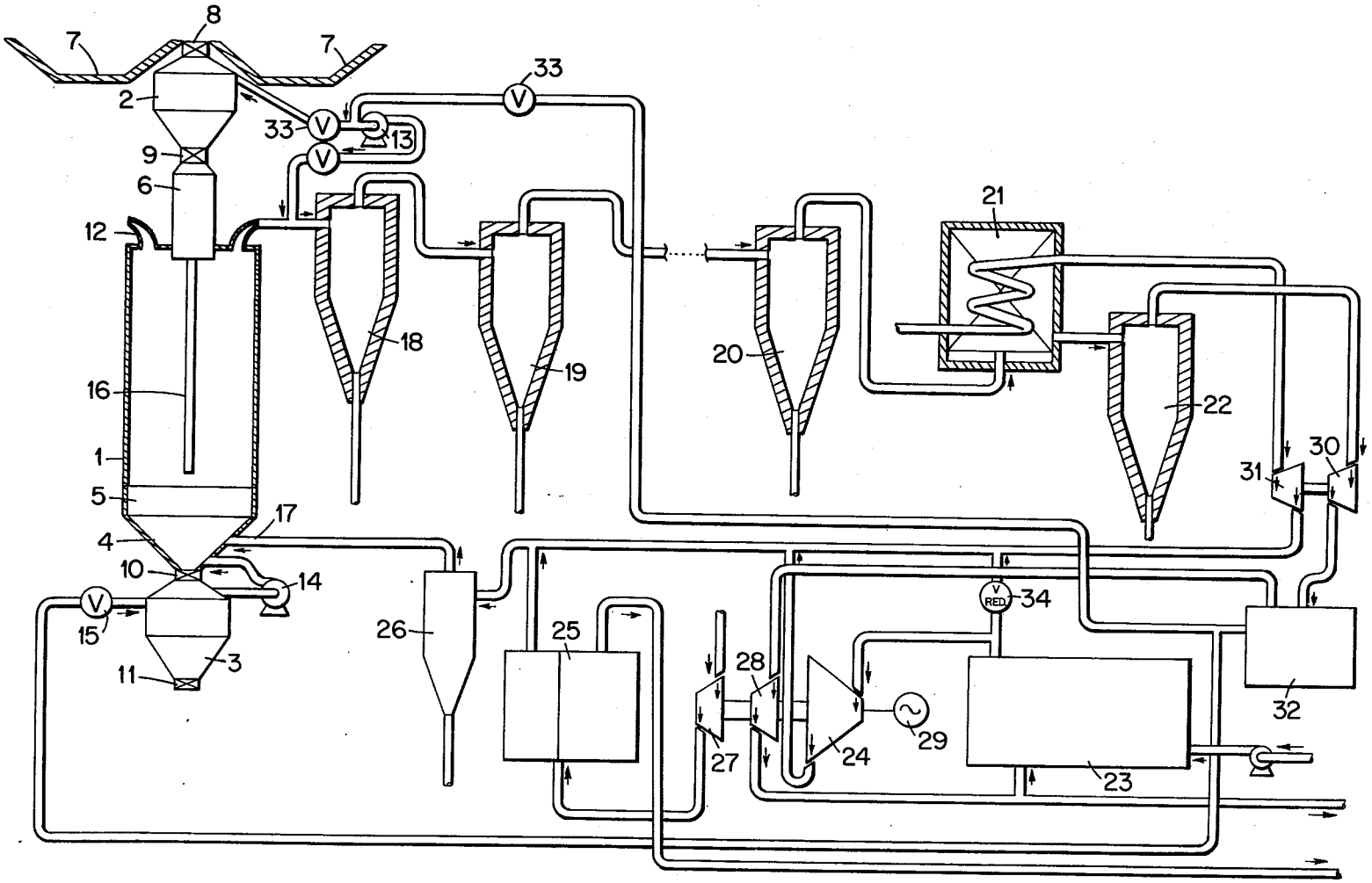
1
2
3
4
5
6
7
8
9
10
11
12
13
14
15
16
17
18
19
20
21
22
23
24
25
26
27
28
29
30
31
32
33
34
RED

PROCESS FOR OBTAINING OIL, GAS, SULFUR AND OTHER PRODUCTS FROM OIL SHALE

This invention relates to a process for obtaining oil, gas, sulfur and other products from oil shale.

More specifically, the present invention relates to a continuous process of pyrolysis, gasification and combustion of oil shale to obtain oil, gas, sulphur and other products, that provides maximum utilization of the raw material with economic advantages, the raw material utilization being practically complete. The process of this invention uses as heat source to promote the gasification and pyrolysis of oil shale the organic material remaining in spent shale after pyrolysis and gasification, at high temperatures, of oil shale, the heat requirement for said reactions being generated inside the process vessel. The said reactions of pyrolysis, gasification and combustion are performed simultaneously in successive reaction zones in the same single processing vessel.

The processing system of this invention, besides being mechanically simple and easily operated, offers the maximum extraction of organic matter, carbon and sulphur that can be industrially attained. Its high yields and relatively low operational costs makes it economically attractive in the processing of oil shale from known oil shale reserves in Brazil and other countries. The present process can be applied, in view of its high yields, to poorer oil shales, whose industrial utilization by other process would be non-economical.

The present process can be applied, with insignificant exceptions, to all oil shales and similar rocks.

The term oil shale means technically a kind of sedimentary rock containing spread throughout the inorganic material an organic matter called kerogen. The oil shale is classified as bituminous oil shale, when the kerogen can be easily extracted by solvent; or pyrobituminous oil shale, the organic matter of which is not easily extracted by solvent, but can be extracted by heating, yielding oil and gases which, after treatment and refining can be used as fuel or as raw material for the petrochemical industry. (In practice, the term, bituminous oil shale, is applied indifferently to pyrobituminous as well as true bituminous oil shale, as above defined.)

It is known that oil and gas from oil shale are composed essentially of hydrocarbons and compounds of the elements C, H, N, S and O.

The present Process may be applied for processing oil shale or other bituminous or pyrobituminous rocks, to all of which the general designation, "oil shale", is hereinafter applied.

The pyrolysis of oil shale consists in decomposition of its kerogen yielding oil, gas and water by the effect of heat only, as the term is herein employed. In general said pyrolysis starts at around 320° C and terminates at near 700° C, the temperature at which the oil delivery ends. The maximum pyrolysis rate occurs at about 430° C through 460° C, but the pyrolysis does not terminate at this point, proceding at decreasing rates delivering gradually denser and denser oil, up to the pyrolysis maximum temperature, around 700° C, at which point pyrolysis terminates even if the temperature is increased. From the above, one may conclude that the pyrolysis carried out at 460° C through 490° C will be incomplete, leaving still considerable amount of kerogen in the pyrolysis spent shale, which is, of course, detrimental to the process yield.

The spent shale of pyrolysis, even when the pyrolysis has been accomplished at said maximum pyrolysis temperature, still contains considerable amount of fuel matter — composed essentially of carbon, hydrogen and sulphur, presenting also considerable heat value, for instance, in the case of Brazilian oil shale from the Irati Formation, 40% of the crude oil shale heat value, or greater, depending on the temperature at which the pyrolysis has been performed and on the properties of the crude oil shale employed.

Several processes have been proposed and conceived for the production of oil and gas from oil shale, differing one from the other chiefly in the method and means employed to promote the oil shale pyrolysis and extraction of its products.

Besides the characteristics of each oil shale, the yields, operating costs, products quality and therefore the profitability of the oil shale industry will depend on: the process and/or operating methods employed to generate and transfer heat to the oil shale; the fuel utilized; the operating temperatures and many other operating procedures and details.

The known previously proposed processing methods can be classified in two principal groups: (a) External-Combustion Processes, in which the oil shale pyrolysis is promoted by transfer of the sensible heat of a material-solid in some cases (as TOSCO Process, of The Oil Shale Corp., that utilizes ceramic balls as heat carrier) or recycle gas, in other cases — the said gaseous or solid material which serves as heat carrier being heated separately from the oil shale to be processed and recycled or recirculated through the bed of oil shale and a heater, in which said heat carrier is re-heated after it has given heat to the oil shale, promoting its pyrolysis; (b) Internal-Combustion Processes wherein combustion of the residual carbon and hydrogen from the spent shale of the pyrolysis is carried out in the same processing vessel where pyrolysis takes place by injecting air and recycle gas into the said processing vessel; or by the combustion of the shale gas with air, the said shale gas product being partially recycled into the process vessel, generating thereby the heat required for the pyrolysis and promoting internal heat exchange through the different zones of the said oil shale moving bed by direct countercurrent contact between the gas and oil shale. The liquid products are condensed and separated from the gaseous flow. As some examples of this group one can name: the process of Union Oil Company — U.S.A., and the Bureau of Mines Gas-Combustion Process — U.S.A.

Among others there can also be still cited the processes in use in Estonia — USSR, of the external-combustion type, with indirect heating of crude oil shale, wherein the pyrolysis heat source are the combustion gases, from the air combustion of the spent shale of the pyrolysis process and wherein the said combustion gases do not make direct contact with the oil shale being subjected to pyrolysis, heating the said oil shale through the vessel walls to prevent dilution of the products of pyrolysis by the said combustion gas.

This Estonian process is used for the richer oil shale with average oil content 20% or of higher grade. Oil shale of low grade, about 7% oil content, is used in said country as solid fuel in fluidized bed combustion process for electrical power generation.

Another alternative that has been thought of is the so-called in-situ retorting whereby oil shale is heated where it occurs in nature, in its own deposit. The disadvantage of this solution is chiefly the great heat loss involved, since the sensible heat of the rocks cannot be recovered or its recovery would be a very complex and problem-ridden task.

The said external combustion process using ceramic balls developed by The Oil Shale Corporation presents mechanical complexity in the recirculation of the said balls heated at high temperatures in the amount needed on an industrial scale, besides the following disadvantages: high costs of said balls that are subject to wear; impossibility of application to oil shale of high sulphur content as the case of the Brazilian Irati Formation oil shale, since the said process utilizes as fuel the spent shale from the oil shale pyrolysis section, which procedure, as will be seen later on, cannot be applied to the said Irati oil shale. The use of another fuel to heat said balls would overcome the difficulty, but would increase the process cost by the amount of the fuel value employed and, in addition, would not take advantage of the utilization of the pyrolysis spent shale.

The external-combustion processes using recycle gas-generated in the same process — as heat carrier for heat exchange through the different zones of the moving bed of oil shale being processed, the pyrolysis temperature being limited, chiefly by mechanical reasons, to about 500° C or lower, present the following disadvantages:

a. They do not make use of the heat value and do not recover the sulphur of pyrolysis spent shale, the said heat value being, in general, higher that the process heat demand; for instance, in the Brazilian Irati oil shale case, wherein the heat value of pyrolysis spent shale is about 40% of the crude oil shale heat value and the residual sulphur content of said pyrolysis spent shale represents about 70% of the sulphur content of the corresponding raw oil shale, the gross yield that can be attained in energy terms is limited to the theoretical maximum of about 60% and the gross sulphur recovery is limited to the theoretical maximum of 30%. Thus, the pyrolysis spent shale rejection involves wasting considerable amount of raw material, which disadvantage is emphasised when one consider that high costs are incurred in mining, transportation, crushing, classification and handling of the oil shale to be processed.

In the said particular case of Irati oil shale, the disposal of pyrolysis spent shale would involve also an additional onus corresponding to the cost of special measures required to prevent spontaneous combustion of said spent shale at the locale of disposal. Said combustion could occur should said spent shale simply be piled and exposed to the weather. Said special measures to prevent combustion of pyrolysis spent shale would be essential to avoid intolerable atmospheric pollution that would be caused by emanation of highly poluent gases — $SO_2$, $H_2S$, CO, $C_nH_m$, etc. — in unacceptable amounts in an industrial scale operation.

b. Low yields of oil, gas and sulphur because the pyrolysis is only partially effected as can be inferred from the above description of the pyrolysis reaction and the nominal maximum process temperature referred to — up to 500° C.

c. Relatively high discharge temperature of spent shale which implies less recovery of the sensible heat of said spent shale, and, therefore greater process heat demand.

d. Mechanical complexity and operating difficulties.

The internal-combustion processes using air and recycle gas, besides the high cost of the recycle compressor, present as a great disadvantage the dilution of the gas product with the nitrogen of the air utilized to promote the combustion of the pyrolysis spent shale and/or recycle gas, resulting in a gas product of poor heat value, practically useless. In addition, the internal-combustion processes would not be applicable to processing oil shale of high sulphur content as in the case of said Irati oil shale, because they would cause, in industrial scale operation, prohibitive atmospheric pollution — as previously remarked in respect to the weather combustion of pyrolysis spent shale from the said geological Irati Formation — since the separation and recovery of the acid gas components of the product gas of said internal-combustion processes, using air injection, would be economically unfeasible, due mainly to the great dilution by the nitrogen of the air employed, which dilution however would not be sufficient to solve the said pollution problem (dilution is not a solution for pollution).

The summary discussion and indication of the disadvantages and drawbacks of the main processes considered, presented above, aim solely: (a) To emphasize the basic differences between the chief known processes and the Process of this invention; (b) To point out the main technical and economic problems it is proposed to resolve and/or overcome by using the Process of this invention; (c) To point out the technical and economic advantages which can profit the industrial companies that use the present Process, these being further explained below.

The process of this invention presents the following main advantages:

a. By promoting the utilization and recovery of the residual organic matter, fixed carbon and sulphur of the pyrolysis spent shale, exhausting the oil shale of the useful material, it is a process that does not waste or spoil the raw material;

b. The spent shale of the present Process, by having been essentially exhausted of carbon and sulphur, is as clean residue, that does not present for its disposal the above described problem of pollution prevention, presented by the residual shale resulting from other processes.

c. Without prejudice to the yields of oil and pyrolysis gas that can be gotten by other processes, the present Process produces an additional amount of gas (fuel gas) obtained by gasification of the fixed carbon of pyrolysis spent shale.

d. Provides greater final yields in fuel and sulphur: for instance, for the Irati oil shale the total yield in oil plus gas (fuels) in energy terms (kcal) can be estimated as high as 30% greater than the corresponding yields of processes limited to a partial pyrolysis (at 460° C to 490° C), while the elementary sulphur recovery corresponds to 4 or more times the amount yielded by other process presently considered for industrial application.

e. It obviates utilization of expensive large recycle gas compressors.

f. It obviates utilization of a heater for the recycle gas, ceramic balls or other matter used in other process as heat carriers and obviates as well the utilization of a hot transfer line or device to recycle hot gas or solids into the process vessel and also the use of a hot gas distributor inside the said vessel.

g. It provides recovery of already pre-fractionated liquid products that reduce the costs of refining the oil product.

h. It makes possible practically direct obtaining of aromatic products.

i. Valuable by-products are obtained in large volume, mainly $N_2$ and $CO_2$ that can be used in a petrochemical plant integrated with the oil shale industry ("schist-chemistry") aiming at the production chiefly of ammonia, urea, fertilizer, etc.

j. It presents good operating flexibility, including making possible the cracking of the products of pyrolysis of oil shale (oil) in controlled intensity, inside the same process vessel and in the same processing operation from which said products are delivered.

k. By virtue of the greater efficiency of the present Process in extracting the in volatile matter, the fixed carbon and sulphur of oil shale, the correspondent amount of residual solid is less than that of other known process, which represents a corresponding reduction in the cost of transportation and handling of said residue.

l. The lower solid discharge temperature involves less heat loss, in view of the better recovery of the sensible heat of the spent shale.

m. The spent shale from the present Process, being essentially exhausted of fuel and polluting matter, presents good possibilities — indubitably better than those presented by the spent shale resulting from simple oil shale pyrolysis by other processes — for various industrial uses, for example: as catalyst for chemical and petrochemical industries; for manufacture of construction material (low density bricks, with good insulating quality, etc.); refractory and thermal insulating material; for paving of roads; for soil conditioner like, for example, the spent shale of Estonia utilized in that country.

n. The equipment needed is mechanically simpler that that for other processes.

o. The present Process is easy to operate and control, in addition to its above mentioned operating flexibility.

p. Little head loss in the moving bed of oil shale.

q. Low heat and overall energy requirement.

r. The thermal heat demand of gasification, drying and pyrolysis of oil shale is supplied by the combustion of the last remaining portion of carbon, sulphur and hydrogen of the pyrolysis and gasification solid residue — these residual substances being otherwise useless for other purposes — the heat being generated where it is required, which results in the most profitable utilization of the heat of said combustion.

s. For a given oil shale charge, the apparent higher costs of installation and operation that may be foreseen for the present Process (compared with the corresponding costs for other processes) due to the use in the present Process of a greater number of process vessels, costs related to the large scale oxygen separation plant and other possible costs of the present Process can be foreseen as amply compensated for and overcome by the exclusion of more complex equipment, by the easier operability and control of the present Process and, mainly, by substantial increase in the income resulting from the additional products and by-products of the present Process.

t. As a corollary of the above, the utilization of the present Process provides a substantial relative increase in the fuel recoverable reserves of oil shale resulting from the rational utilization of the raw material which the high yields signify; with the yields of the present Process, it can be predicted that an oil shale reserve with a potential of net production of fuels (oil and gas), equivalent to 100 million cubic meters, as recoverable by other processes of pyrolysis, for instance, will have its total net production of oil and gas increased by the equivalent of up to about 30 million cubic meters of oil.

u. Similarly, as said above, the present process provides a huge relative increase in the recoverable reserves of sulphur from high sulfur content oil shale deposits such as the Irati oil shale: the high sulphur yield of the present Process more than 4 times the corresponding yield of processes limited to effectuate only the oil shale pyrolysis effectively multiplies by four (or more) the recovery of sulphur from the reserves of the known deposits of "oleigen" Irati oil shale (that is oil shale useful for economic recovery of oil), said sulphur being associated with the oil shale; this advantage deserves to be remarked even more if it is borne in mind that sulphur is a basic and very important raw material indispensable for many industries and of noteworthy importance for agriculture (as raw material for manufacture of fertilizer).

It is worthwhile to remark also that the fact of the present price of sulphur being relatively low (about one third of the said price five years ago) does not invalidate the advantage and importance of having an internal abundant source of supply of this material, especially, when one considers that the present price is subject to be, at any time, substantially increased, as occurred not so long ago with this material and more recently with petroleum and almost all other basic raw materials.

v. Possible addition to the recoverable reserves of fuel and sulphur from oil shale by utilization of oil shale deposits of lower oil and sulphur contents as well as of the deposits of minor potential not economically useful by application of other processes, but profitable by the present Process, in view of the lower break-even point that can be foreseen for the present process, due to its theoretical yields and returns.

The appended drawing, which serves as a flowsheet, schematically illustrates the present process.

Shown therein is vessel (1) preferably insulated to prevent heat loss and complementary parts and accessories: charge buckets (7), charge bin (2), oil shale feeder duct (6), upper valve (8) of said charge bin, bottom valve (9) of charge bin, discharge mechanism (5), auxiliary discharge bin (4), discharge bin (3), upper valve (10) of discharge bin, bottom valve (11) of discharge bin, gas colectors (12), charge bin exhaustor device (13) and discharge bin exhaustor device (14), purge device (33) of charge bin (2) and similar purge device (15) for discharge bin (3), tube for moving bed internal thermocouple bundles (16) and gas injector (17).

Accordingly, as shown in the flowsheet of the drawing, the present Process operates as follows: crude raw shale to be processed, having been mined, crushed, classified in adequate particle size range and homogenized by a suitable method of mixing, is charged into the charge buckets (7) by suitable transportation and charging equipment, staying therein until the proper moment for its introduction into the charge bin (2). The oil shale processing is continuous, although the charge of raw oil shale and discharge of spent shale are intermittent.

When the charge bin (2) gets emptied, which is detected by a device just below the charge bin bottom valve (9), the upper valve (8) of the charge bin being closed and the bottom valve (9) open, said bottom valve is then closed and the preparation of the next charge bin (2) for the charge takes place as later described. Once the bin (2) is prepared to receive a new charge of oil shale, a pair of buckets (7) is operated to completely fill said bin (2). Each bucket (7) has half the volumetric capacity of charge bin (2). Next, the upper valve (8) is closed and the air contained in bin (2) is purged by means of an appropriate operation of suitable devices provided for this purpose. After the air (that has penetrated into the said bin) has been expelled or reduced to the practical minimum, the upper valve (8) is closed and the charge bin (2) is pressurized, equalizing its internal pressure with the internal pressure of the vessel (1) by introducing a pressurized purge gas into the charge bin (2). Next the charge bin bottom valve (9) is opened and the charging operation is completed. The volume of feeder duct (6) of the vessel is compatible with the processing mass flow rate and the time period needed for the operation of charging the charge bin (2) — including the complete preparation of the charge bin (2) to be put in communication with the process vessel (1) interior by the said feeder duct (6) — in order to assure an essentially continuous oil shale supply to the moving bed. Once the charging operation of the charge bin (2) is completed, the cycle is repeated with the discharge and recharge of said charge bin (2).

The charging operation, in resume, consists in the chronological sequence: closing of the charge bin bottom valve (9); recovery of the gases therein contained; opening of the charge bin upper valve (8); filling the charge bin with the oil shale from the buckets (7); removal of the air that has been trapped with the oil shale, on the closing of the charge bin upper valve (8); repressurization of said charge bin with a gas from the process; and, finally, opening of the charge bin bottom valve (9).

The bulk oil shale held in the charge bin (2), after completion of the charging of the charge bin operation, flows by gravity through the feeder duct (6) to the top of the moving bed contained in the vessel (1) wherein said coarse oil shale spreads along a conical surface area in accordance with the angle of repose of bulk oil shale. Alternatively, the oil shale is spread, by means of a mechanical anti-segregation device, along an essentially horizontal area at the top of said moving bed. The bulk oil shale introduced in a continuous way to the top of the moving bed contained in the vessel (1) flows downward by gravity action, traversing, slowly the entire height of the vessel, wherein said oil shale is subjected to the processing action and the resultant spent shale (the solid residue of the process, essentially a calcined material) is collected in the auxiliary discharge bin (4). The rate of flow of the spent shale (and so the process rate of flow) is controlled by means of a Discharge Mechanism (5) which proportionates a controlled and essentially uniform discharging rate along the bottom vessel cross section, so that all the particles of oil shale have essentially the same residence time along the moving bed, flowing essentially at the same velocity downward. It is also important to avoid channeling, that is, preferential gas flow through holes or channels inside the moving bed, that would provoke or involve bad gas flow distribution through the moving bed, with loss of process efficiency.

The spent shale, of this process is the raw oil shale after have been essentially exhausted of organic matter, fixed carbon and sulfur.

The oil shale processing occurs in its descending flow through the vessel (1), in various simultaneous, successive and continuous stages: in the upper bed occurs the drying of oil shale moisture and heating to the level of temperature needed for said the oil shale kerogen pyrolysis. Heating is provided by heat exchange through direct contact with the ascending gases which percolate counter-currently through the said moving bed. Said gases are composed of steam, admitted in the auxiliary discharge bin (4) below the Discharge Mechanism (5) and of the gases and vapor generated successively by pyrolysis, gasification and combustion of the oil shale. After drying the oil shale is subjected to progressive heating until it reaches the zone corresponding to the pyrolysis temperature range (320° C to 700° C) — the pyrolysis zone — wherein takes place the pyrolysis of the kerogen of the oil shale, said pyrolysis being characterized by the transformation of said kerogen into, essentially: oil, gases and water vapor that evolve from the oil shale and are incorporated in the ascending gaseous stream. Just below the said pyrolysis zone, without a clear boundary, the continuous heating or pyrolysis spent shale causes it to attain, in the subsequent gasifying zone, a temperature range of about 760° C up to the maximum bed temperature. In the said gasifying zone there takes place essentially the known water gas reaction, consisting in the combination of the water vapor with the residual carbon of pyrolysis spent shale, resulting in the formation of $H_2$, CO and $CO_2$, and the formation of $H_2S$ derived from the residual sulfur of said pyrolysis spent shale. Just below said gasifying zone the gasified spent shale enters the combustion zone (also without a clear limit between the combustion and gasification zones) wherein its temperature rises to the moving bed maximum temperature — maximum process temperature — by the effect of the heat generated by the combustion of the fuel matter remaining in the said gasified spent shale, that is, essentially, carbon, sulfur and hydrogen, said combustion consisting of the combination of C, H, S with the oxygen injected below the moving bed mixed with steam. Said combustion is the source of the heat required for the process. Below the combustion zone there takes place the cooling of the spent shale (calcined shale) by heat exchange in direct contact with the ascending gaseous mixture, said mixture consisting essentially of water vapor (steam) and oxygen, said mixture being injected below the moving bed. The spent shale is cooled to the lowest feasible temperature; the spent shale discharge temperature is controlled at around 120° C through 150° C, just above the inlet temperature of said steam-oxygen mixture, which is of the order of 105° C through 135° C. From the Discharge Mechanism (5), installed in the bottom of the process vessel (1), the spent shale falls into the auxiliary discharge bin (4) integral with vessel (1), and duly tight against gas leakage from and to the outside. The discharge bin upper valve (10), situated between the auxiliary discharge bin (4) and the discharge bin (3), being open and the discharge bin bottom valve (11) being shut, the spent shale continuously falls from said auxiliary bin into said discharge bin. Once said discharge bin (3) is completely filled, which is detected by a suitable device, the discharge operation and preparation of said discharge bin for refilling is started. Said discharge and preparation of the discharge bin (3) for the refilling operation consists in an operation similar to the feeding and preparing operation of the charge bin (2) for each new feed of said charge bin. In brief, the discharge operation, preferably performed automatically by means of suitable control devices, is carried out in the following operational sequence: after the level of spent shale at the highest level settled, is detected by the above mentioned suitable device as being just below the discharge bin upper valve (10), said valve is shut off. The discharge bin upper valve (10) is constructed to completely seal the discharge bin against gas leakage from and to the discharge bin (3) during the spent shale discharge operation.

Next the discharge bin (3) is depressurized in order to avoid or lesson loss of the gaseous mixture of oxygen and steam contained therein by the exhaustion, through the discharge bin exhausting device (14), of said gaseous mixture, this mixture being readmitted into the process vessel (1) through the said auxiliary discharge bin (4). At the same time as exhaustion of said oxygen-steam mixture is effected, a purge gas is injected into the bottom of said discharge bin so that the purge gas displaces the oxygen-steam mixture. The purpose of this purge operation is to avoid loss of oxygen and steam.

The gas flow occurs in the following manner: steam is generated in a conventional Boiler (23) at high pressure and a superheat temperature suitable for driving steam-turbine (24) that moves gas compressor (27, 28) and Electric Power Generator (29). Also, in the Desulfurization of Oil Shale Gas Plant (21) there is produced steam of medium superheat temperature and pressure, which is first utilized to drive turbine (31) that moves gas compressor (30). From said turbines steam is withdrawn at saturation temperature or near that, at low pressure, about 1.5 to 3 atm. abs., and is collected in a process steam pipeline to which is connected the line of oxygen that is separated in the Oxygen Separation Plant (25). The mixture of said oxygen and process steam is homogenized by in suitable device that can be a cyclone (26) and said mixture in injected into the auxiliary discharge bin (4) connected to the process vessel (1) and constituting an integral part thereof. The injection of the gaseous mixture is done through a device designed to provide an essentially perfect gas distribution all along the bottom of the Discharge Mechanism (5) through which said mixture reaches the shale moving bed. In addition to the amounts of steam withdrawn from said turbines, a complementary amount of steam, quantum sufficit for the process temperature control, is withdrawn directly from the Boiler (23), through a pressure reduction valve (34). Inside the vessel, in an upward flow through the moving bed, the oxygen-steam mixture brings about the chemical and physical phenomenareactions, heat exchage and removal of liquid and gaseous products of the Process- already mentioned in the above description of the oil shale flow and processing. The gases, vapors and mist of liquid products delivered in the process, mixed with to the steam admitted through the bottom of said moving bed are collected by suitable gas collectors (12) fabricated and arranged to provide good gas distribution of gas flow through the moving bed, ideally equal along all the cross sections of said moving bed, to assure, the uniform and efficient processing of all the bulk shale.

The measurement of moving bed temperatures at several suitable points can be effected by means of thermocouple bundles held in alloy steel tubes (16) arranged vertically, inserted within the said moving bed and tightly sealed against process gas infiltration. The number and arrangement or location of said thermocouple points are such as to provide suitable process control. With the purpose of protecting the wires of said thermocouples, an inert atmosphere is provided and maintained inside said thermocouple bundles tubes by means of suitable devices.

The Liquids recovery system operates as follows: The gaseous mixture, with oil mist, collected in each one of said gas collectors (12), flowing through appropriate piping, reaches a primary cyclone-condenser (18) wherein it is cooled and partially condensed. The liquid products essentially oil and water effluent from each one of said cyclone-condensers are collected in tight containers, through the drain of the corresponding cyclone. From said oil and water containers, where these products are separated by difference of densities, into two well defined phases, each one of the liquid products is separately pumped to a suitable destination. The gaseous flow not condensed in the primary condenser-cyclones (18) goes through a series of other condenser-cyclones (19...20) that constitute, with said primary condenser-cyclones the present liquid recovery system. In passing successively through the condenser-cyclones, the gases are submitted to gradual cooling and at each cooling stage successively lighter oil fractions and decreasing amounts of water are condensed. The gradual cooling can be continued down to temperatures as low as about 10° C to 0° C, in order to attain maximum condensation of water and light fractions of oil under economically favorable conditions. The product gas effluent of the last condenser-cyclone (20) of the liquid recovery system flows to the Gas Treatment Process Unit (21), wherein elementary sulfur recovery takes place by means of the known Claus Process reaction ( $2\ H_2S + SO_2 \rightarrow 3S + 2\ H_2O$) and separation of the sulphur from the gas by a cyclone-condenser (22) and the components of the desulfurized gas are further separated in the degree of refinement suitable for the utilization to which the said desulfurized gas and components are destined.

The treatment of the product raw gas effluent of the above described system of liquid recovery can be effected by many known methods. However the economics of the industrial plant will depend substantially on the raw gas treatment process adopted. The removal of acid gas by absorption in a liquid is unfeasible in the present case, either for economic reasons or for technical ones: the regeneration of used solution, generally effected by steam heating, would be much too expensive due to the high heat required for removal of the large amount of $CO_2$ present in said raw gas product; on the other hand in the case of Irati oil shale which bears a high sulfur content, the raw gas contains $H_2S$ and $SO_2$ in amounts approximately equivalent to the stoichiometric proportions of said Claus reaction, which would cause the formation of sulfur inside the absorbing equipment, in the liquid absorbing solution, rendering difficult, if not unfeasible, operation of such a process. Among several other technical and economic possibilities, the following methods of treating said raw gas, in stages, present themselves: in a first stage the said raw gas is straightly treated in relatively simple equipment, suitable for promoting said Claus reaction. This primary treatment may consist essentially in making the gas pass through a solid (dry) catalyst bed wherein the major part of the sulfurous gases, namely $H_2S$ and $SO_2$, is converted into elementary vaporized sulfur, said sulfur being condensed by cooling the flowing gas containing the sulfur vapors, and said vaporized sulfur recovery system may be similar to the above described liquid recovery system for oil and water recovery from the effluent of the oil shale processing vessel. The gas effluent of the said primary treatment process will still contain some amount of sulfurous gases, which may be removed in other treatment stages by one or more suitable methods. To facilitate such other gas treatment stages, the two types of sulfur compounds, essentially $H_2S$ and $SO_2$, can be reduced to only one, $SO_2$ (or $H_2S$) by adding an amount of $SO_2$ (or $H_2S$) which will assure sufficient excess of $SO_2$ (or $H_2S$) in relation to the $H_2S$ (or $SO_2$) content so that essentially all the amount of $H_2S$ (or $SO_2$) will be consumed in the Claus reaction and thereby eliminated from the gas composition effluent of the first treatment stage. In the stages following after the primary treatment, the desulfurization is completed and separation of several gas components is promoted in the refinement degree suitable for the use that will be made of the treated gas.

Among other possible utilizations of the desulfurized gas worth mentioning because of its importance and the presence of the facilities involved in the oil shale plant installation and operation, the use of the gas in an integrated petrochemical industry (schistchemical) wherein the nitrogen — obtained as by — —product from the oxygen separation Unit (25) — and the sulfur recovered from the raw gas can also be used. Among others the following basic products could be advantageously produced: sulfuric acid, ammonia, nitric acid, fertilizers (ammonium sulfate and nitrate) urea, alcohols and a large range of products usually obtained in the petrochemical industry. Besides such application in the petrochemical industry, it will be recognized that the desulfurized gas may be used as domestic and industrial fuel in the great comsuming centers near the production site and alternatively as fuel for the oil shale industry itself.

Whatever the application of the said desulfurized gas may be — for schistchemical or for domestic or industrial fuel, it should be compressed at high pressure such as, for instance, 20 atm. or more. Said compression can be advantageously effected by compressors driven by extraction stream — turbines installed nearby or integrated to the oil shale processing plant. It is thus made possible to obtain low pressure process steam as a by — product of said gas compression operation. Such steam, withdrawn from the gas compressor driving turbines, will join the process stream flow withdrawn from other turbines or from the above mentioned Boiler.

The liquid recovery system consists of one or more series of condensor-cyclones suitably arranged. The said condenser-cyclones are made of known cyclones surrounded by a water jacket in the space between two concentric cyclones The gas to be cooled circulates inside the internal cyclone and the water or other cooling fluid circulates in the space which serves as said jacket; In homologous cyclones which are functionally equivalent the cooling water may be replaced by another cooling fluid, such as shale oil or shale gas in the case of the present process. The main advantages of the present recovery system, are, as compared with other systems, for instance electrical precipitators and shell-and-tube condensers:

low installation cost;
high heat exchange factor;
low or practically non-existent maintenance cost;
easy operation control.

The operating conditions can be set in accordance with the average properties characteristic of each oil shale, as well as for higher or lower desired cracking of kerogen pyrolysis products, aiming at major or minor yields of gas, aromatics, etc. in the same oil shale processing vessel.

The maximum bed temperature occuring in the combustion zone should kept at the highest possible level in order to obtain maximum utilization of the fixed carbon. This limit will be established depending on oil shale properties, chiefly the clinkering point of calcined spent shale. (Clinkering is agglomerate formation which occurs at incipient fusion.) For Irati oil shale the maximum bed temperature can be controlled at around 1050° C through 1200° C by using a special discharge mechanism that provides precise control of the spent shale discharge even when clinkering occurs. With precise control of the other variables, the process can be maintained in operation with little fluctuation of the maximum moving bed temperature. The most important advantage of operation at such high temperatures and occasionally a little higher than the above indicated values — made possible due to utilization of said special discharge mechanism and other devices — consists in maximizing the utilization of spent shale fixed carbon (as well as sulfur and hydrogen) thereby obtaining maximum removal and recovery of sulfur from oil shale and significant reduction of the amount of solid residue. All those effects will obviously result not only in the best utilization of the raw material but also in increasing the industrial profitability.

The design operation pressure should be from 1 to 3 atm. abs. Operation at pressures substantially higher than atmospheric pressure is made possible by employing special operating equipment and operating procedures above described. Said operating possibilities of the present process lead to the following advantages as compared with known processes:

increase of reagent ($O_2$ and $H_2O$) partial pressure, which leads to increased reaction rates, and degree of completion of the reactions involved therefore providing better yields and significant cost reduction;
lessening of head loss in the moving bed, in the piping etc;
better condition of the raw gas for the primary treatment of said gas and several other favorable effects.

What I claim is:

1. A process for obtaining useful products from oil shale, comprising introducing crushed raw oil shale through the upper part of an essentially vertical processing vessel, causing said shale to move continuously downwardly as a moving bed, continuously introducing a gaseous mixture consisting essentially of oxygen and steam into the bottom of said moving bed, whereby an ascending gaseous stream continuously contacts said downwardly moving bed, said moving bed of shale passing, successively, through a drying and heating zone, a pyrolysis zone in which the temperature ranges from about 320° C. to about 700° C., a gasification zone in which the temperature ranges from about 760° C. up to the maximum bed temperature, a combustion zone and a cooling zone, withdrawing the spent shale from the bottom of the vessel, and withdrawing the resulting vapor, oil mist and gas product stream mixed with unreacted introduced steam from the upper portion of the processing vessel; said pyrolysis comprising converting the kerogen of the oil shale into essentially oil, gases and water vapor, leaving residual carbon, hydrogen and sulfur in the shale; said gasification comprising the reaction of steam with said residual carbon and sulfur in the shale to form $H_2$, CO, $CO_2$ and $H_2S$; said combustion comprising the burning of fuel matter remaining in the shale with the introduced oxygen, and serving as the source of heat required by the process, the temperature of the combustion zone being the maximum bed temperature, said temperature being controlled slightly lower than the clinkerization point of the spent shale, but being permitted to reach said clinkerization point occasionally, and the amount of steam employed being sufficient to assure such control of the maximum bed temperature and the presence of the gasification zone above the combustion zone.

2. The process of claim 1, wherein the steam and oxygen mixture is introduced into the bottom of the processing vessel, below the moving bed, at a temperature of about 105° C. to 135° C. and a pressure of about 1 to 3 atmospheres, absolute, the maximum bed temperature is between about 1050° C. and 1200° C., and the spent shale is cooled to between about 120° C. and 150° C. prior to withdrawal from the processing vessel.

3. The process of claim 1, wherein the oxygen supplied to the processing vessel is obtained by separation from air and the steam supplied to the processing vessel comprises steam withdrawn from steam turbines which supply power for the process, including that for the oxygen separation; complemented by steam directly withdrawn from the boiler that provides steam for said turbines.

4. The process of claim 1, wherein the steam, oil mist, gas and vapor products withdrawn from the processing vessel are passed through a series of condenser-cyclones, wherein the vapors are gradually cooled and successively lighter oil fractions and decreasing amounts of water are condensed and the product gas effluent from the last condenser-cyclone is desulfurized and elementary sulfur is produced by the Claus reaction and recovered from the gas and the components of the desulfurized gas are recovered.

5. The process of claim 1, wherein the processing vessel is insulated to prevent heat loss and the charging and discharging of the shale respectively to and from the moving bed are controlled to provide uniform feeding and discharge.

6. The process of claim 1, wherein the oil shale processing is effected under an essentially constant superatmospheric pressure, the oil shale feeding into the processing vessel being effected through one or more charge bins and the discharge being effected from one or more discharge bins, each of said bins being provided with an upper valve and a lower valve, said processing vessel and bins being provided with:

feed buckets, auxiliary discharge bin;

means for recovery of gases contained in said charge bin, before said bin is open for refilling;

means for recovery of steam-oxygen mixture contained in said discharge bin before said bin is discharged;

means for expelling air from the charge and discharge bins before replacement of said bins in communication with the interior of said processing vessel after the respective feeding and discharging operations.

7. The process of claim 6, wherein the oil shale is initially held in the charge bin, then brought directly and continuously onto the top of the moving bed, inside the processing vessel, in an essentially constant and adjusted flow, through a feeding tube.

8. The process of claim 7, wherein the oil shale moves through segregation preventing means installed between said feeding tube and the upper part of the moving bed.

9. The process of claim 7 wherein the feed buckets are fed with crushed raw oil shale and when the charge bin gets emptied of the said raw oil shale therein held, the refilling operation of said charge bin being effected in the following operational sequence:

a. the bottom valve of said charge bin is tightly closed;

b. the gases held in said charge bin are withdrawn by gas recovery means;

c.the upper valve of said charge bin is opened and the oil shale held in said feed bucket is discharged into said feed bin;

d. said upper valve is closed and the air that has entered said charge bin is expelled by injecting into said charge bin shale gas obtained in the present process;

e. the bottom valve of said bin is opened.

10. The process of claim 6, wherein the calcined spent shale is discharged from the bottom of said moving bed, falling through discharge means which proportions a controlled withdrawal of said calcined spent shale from all along the cross section of said moving bed.

11. The process of claim 10 wherein said discharge means is adapted to permit precise control of spect calcined shale discharge even if occasional clinkerization of said calcined shale occurs.

12. The process of claim 6, wherein when the calcined spent shale reaches the upper level of said discharge bin near the upper valve of said bin, the discharging operation is effected in the following operational sequence:

a. said upper valve of said bin is closed;

b. the gases held in said bin are withdrawn by oxygen-steam mixture recovery means;

c. the bottom valve of said bin is opened and the calcined spent shale is discharged from the system;

d. said bottom valve of said bin is closed and the air which entered during discharge is expelled by introducing into said bin gas derived from the present process;

e. the upper valve of said bin is opened, thereby beginning a new calcined spent shale collecting cycle.

13. The process of claim 6, wherein half of the volume of oil shale that can be held in each said charge bin is fed into each of two feed buckets symmetrically disposed with respect to said charge bin, said buckets, articulated with the upper edge of said charge bin, being driven in a tipping angular movement, whereby said buckets are emptied, filling said charge bin.

14. The process of claim 6 wherein said oxygen-steam mixture is injected into the auxiliary discharge bin below the bottom of said moving bed, at a pressure of about 1 to 3 atm. abs.

15. The process of claim 6 wherein the mixture of steam, gases and liquid products of the process are withdrawn from said moving bed into gas collectors at the top of said vessel, said mixture flowing in an ascending stream, said collectors being of the same design and symmetrically disposed in order to ensure a uniform and well distributed gaseous flow throughout said moving bed of oil shale.

* * * * *